US011066799B2

(12) United States Patent
Doleshal

(10) Patent No.: US 11,066,799 B2
(45) Date of Patent: Jul. 20, 2021

(54) PROTECTIVE JACKET FOR TAPE-WRAPPED PILE

(71) Applicant: Donald L. Doleshal, Lenexa, KS (US)

(72) Inventor: Donald L. Doleshal, Lenexa, KS (US)

( * ) Notice: Subject to any disclaimer, the term of this patent is extended or adjusted under 35 U.S.C. 154(b) by 0 days.

(21) Appl. No.: 16/693,047

(22) Filed: Nov. 22, 2019

(65) Prior Publication Data

US 2020/0087879 A1 Mar. 19, 2020

(51) Int. Cl.
*E02B 17/00* (2006.01)

(52) U.S. Cl.
CPC ..... *E02B 17/0017* (2013.01)

(58) Field of Classification Search
CPC combination set(s) only.
See application file for complete search history.

(56) References Cited

U.S. PATENT DOCUMENTS 5,586,838 A * 12/1996 Walsh ..... B29C 53/582 156/187
6,561,736 B1 * 5/2003 Doleshal ..... E02D 27/52 405/211
7,905,069 B1 * 3/2011 Lockwood ..... E04H 12/08 52/514
9,382,631 B1 * 7/2016 Villegas ..... C23F 13/18

* cited by examiner

*Primary Examiner* — Kyle Armstrong
(74) *Attorney, Agent, or Firm* — Kenneth W. Iles

(57) ABSTRACT

A protective jacket encircles a pile that is covered with a protective tape so that the tape cannot unravel, which is a common problem with these wraps. The protective jacket has a number of components that are bolted together to squeeze the pile. The protective jacket has an expanded metal mesh on the inner surface of the jacket, to engage and press against the protective tape wrap to prevent the protective jacket from slipping down the pile due to gravity. Embodiments for cylindrical piles and for H-piles are disclosed.

15 Claims, 6 Drawing Sheets

PROTECTIVE JACKET FOR TAPE-WRAPPED PILE

CROSS-REFERENCE TO RELATED APPLICATIONS

Not Applicable.

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus and process for protecting piles from the effects of water.

DESCRIPTION OF THE RELATED ART INCLUDING INFORMATION DISCLOSED UNDER 37 C.F.R. 1.97 and 1.98

Piles are frequently placed in water to support piers. Any type of pile, particularly steel piles, are subject to degradation, such as erosion, corrosion, barnacle buildup and so forth, especially when the piles are submerged in salt water. Two common configuration of piles are cylindrical piles and H-piles, both of which are addressed by the apparatus disclosed in this paper.

Many efforts to reduce or prevent degradation of piles in the splash zone have been made. Among the most successful is to wrap the portion of the pile that is in the splash zone with a specialized tape, which is usually applied as a spiral wrap. A lightweight, high strength and corrosion resistant tape made from fiber reinforced polymers (FRP) is frequently used. The fibers may be glass fibers, carbon, plastic fibers, and the like. The tape may be coated with resins that set up under water. One such system is described in *Application of FRP Composites for Underwater Pile Repair* by Raja Sen and Gray Mullins, of the Department of Civil and Environmental Engineering, University of South Florida, Tampa, Fla. 33620 USA.

These tape wraps and others work well. The problem with them, however, is that, eventually, they come lose from the pile. Long strands of this tape can often be seen flowing off the pile, still attached to the pile, or simply floating freely in the water. Not only is the protective layer lost, but the tape then pollutes the water.

Therefore, there is a need for an apparatus that will protect the tape and prevent it from unraveling.

BRIEF SUMMARY OF THE INVENTION

Accordingly, it is a primary object of the present invention to provide an apparatus that will protect the tape on a tape wrapped pile.

This and other objects of the invention are achieved by providing a jacket that fits over the pile on the portion of a pile that is wrapped in protective tape.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
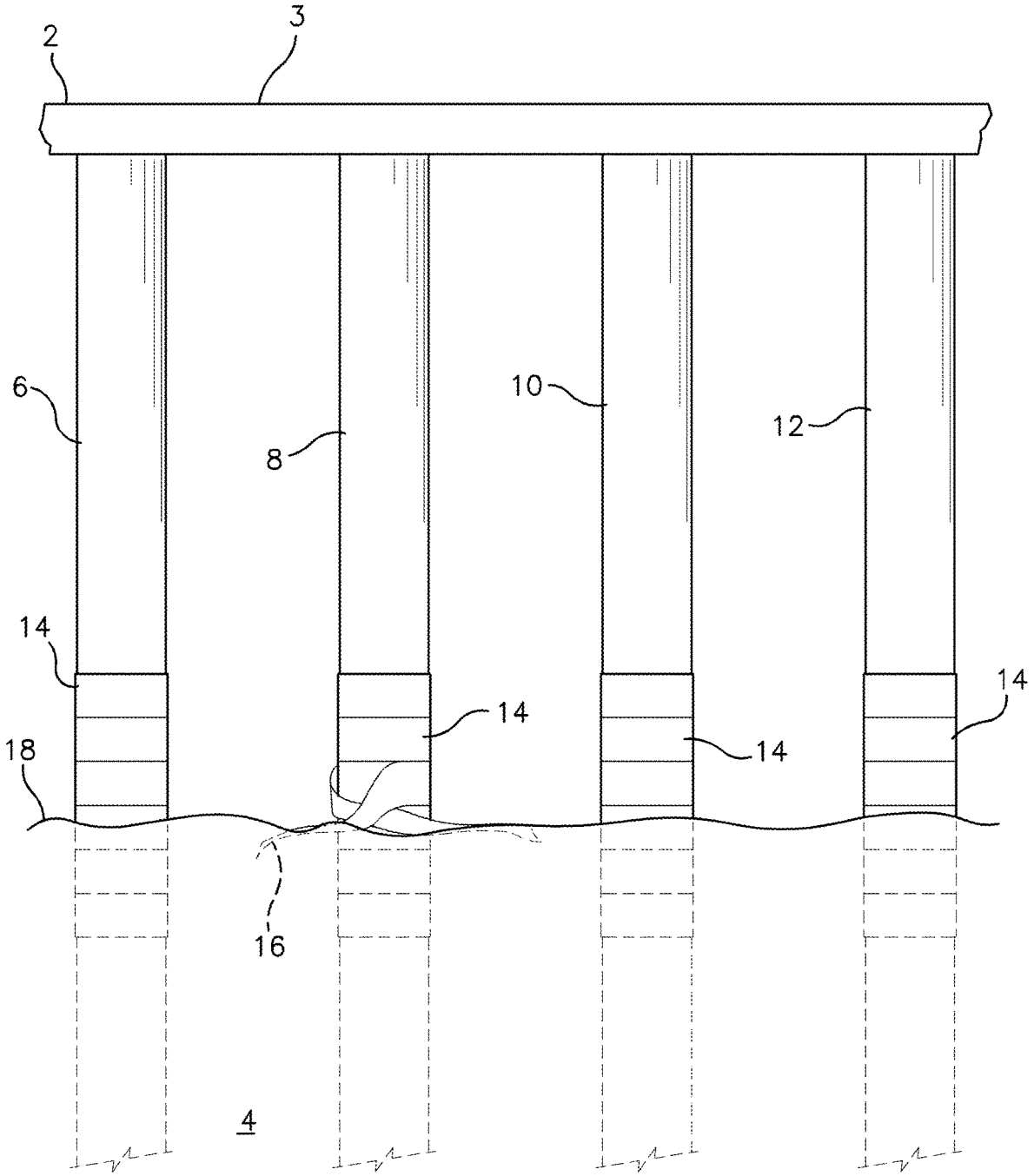
FIG. 1 is side view of a pier supported by piers and showing the cylindrical piles wrapped with protective wrap in the splash zone with the tape coming unraveled on one of the piles.

As shown in FIG. 1, a pier 2, having a deck 3, is supported in water 4 by the piles 6, 8, 10, 12, each being cylindrical, i.e., cylindrical cross sections, and each of which is wrapped in with a wound protective tape 14, with the protective tape 14 on the pier 8 showing unraveling tape at 16. As shown, the tape 14 is wrapped in basically in horizontal bands, but it is frequently wrapped in a spiral fashion. Most corrosion occurs in the splash zone, along the water line 18 and above and below the nominal water line along the lengths of the piles that are exposed to the air and then covered with or splashed by water due to wave action.

Figure 2:
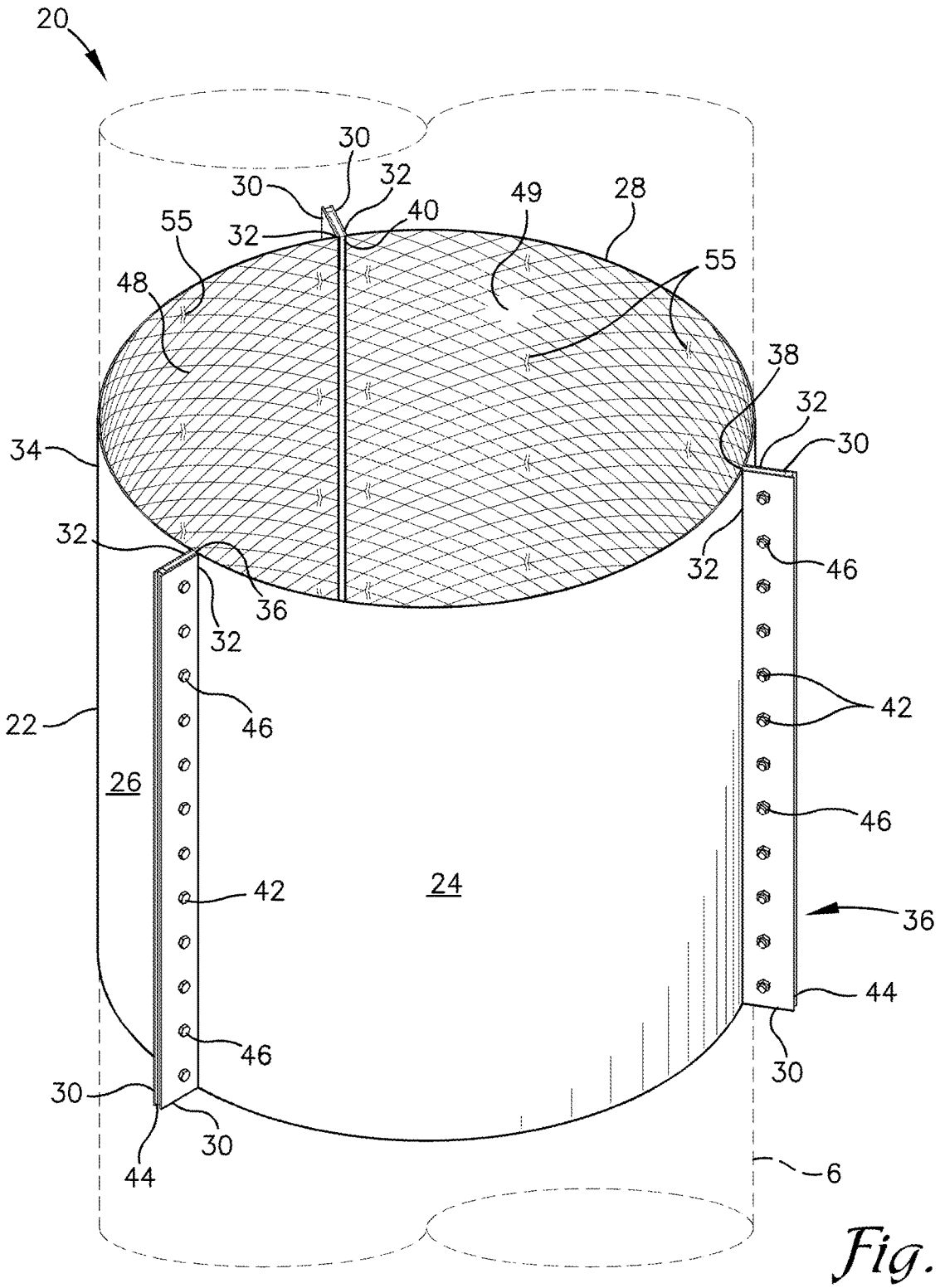
FIG. 2 is an isometric view of a portion of a protective jacket apparatus according to the present invention.

As shown in FIG. 2, a protective jacket 20 to the present invention includes, shown assembled on the pile 6, for example, a jacket segment 22, which comprises three arcuate segments, each of 120° of arc, which are the arcuate segments 24, 26, 28. Each arcuate segment 24, 26, 28, or jacket members 24, 26, 28, has an outwardly projecting flange 30 that runs the entire height of each arcuate segment 24, 26, 28, along the two vertical edges 32 of each arcuate segment 24, 26, 28. Each flange 30 is perpendicular to the circumference of the cylinder 34 that is formed when the three arcuate segments 24, 26, 28 are assembled as shown. Any desirable number of arcuate sections may be used, with a minimum of two arcuate segments, since neither the top nor the bottom of the pile is accessible. Four or more arcuate sections may be used. The arcuate segments may include different degrees of arc in a set of arcuate segments for a single pile. It has been found, however, that, in most cases, the preferred structure is three arcuate segments 24, 26, 28, each having the same radius of curvature and each spanning 120° of arc, that is one-third of the circumference of a circle. The diameter of the cylinder 34 that is formed by the assembled arcuate segments 24, 26, 28 is approximately the same as the outside diameter of the pile that is to be protected. Two flanges 30 mate at each of the vertical seams 36, 38, 40 that are formed when the arcuate segments 24, 26, 28 are assembled.

Still referring to FIG. 2, each flange 30 has a row of vertically aligned holes 42. The row of holes 42 runs the length of each flange 30 and the row of holes 42 in any flange 30 align with the row of holes 42 in any other flange 30. A spacer bar 44 is placed immediately inward of the outer edge of the each two mated flanges 30, that is the outer edge of the spacer bar 44 is adjacent to the outer edges of each of the three sets of two adjacent flanges 30, but occupies only a narrow outer portion of the width of each flange 30, and not projecting inward so far as to be close to the holes 42, that is, the spacer bar is located outside of the rows of holes 42 in each flange 30, so that when the bolts and nuts 46, or other fasteners, that are placed in the holes 42 are tightened, the flanges 30 collapse at the vertical edges 32, which are formed by the flanges 30 being bent away from the vertical edges of each arcuate segment 24,26, 28, thereby allowing the jacket segment to 22 to grip the pile more tightly than it otherwise would. The jacket segment 22 and the entire jacket, must be held tightly against the pile in order to prevent the jacket segment 22 from sliding down the pile due to gravity.

Figure 5:
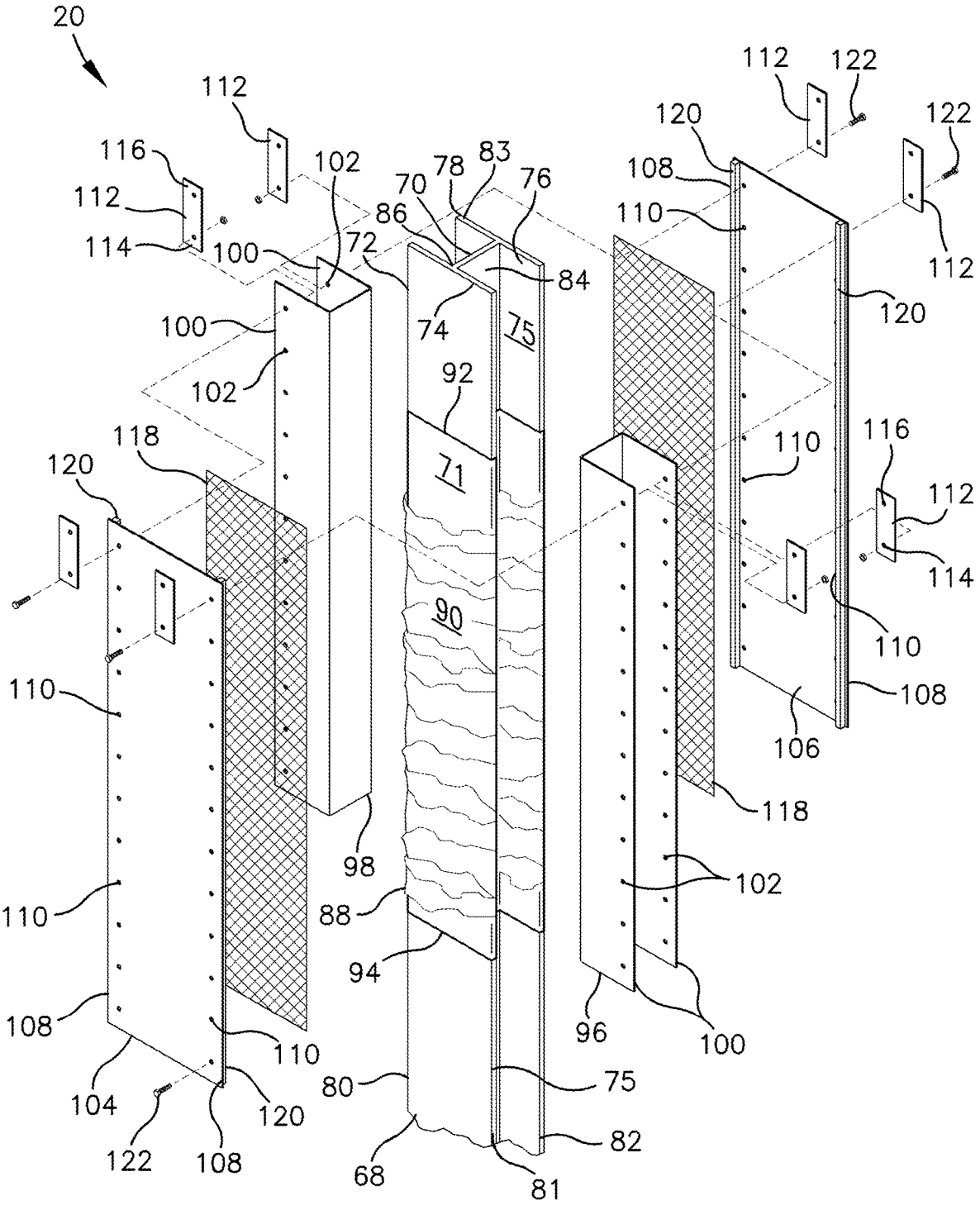
FIG. 5 is an exploded isometric view of an embodiment of the protective jacket embodiment designed for use on an H-pile, showing the H-pile in the center of the Fig.
Figure 6:
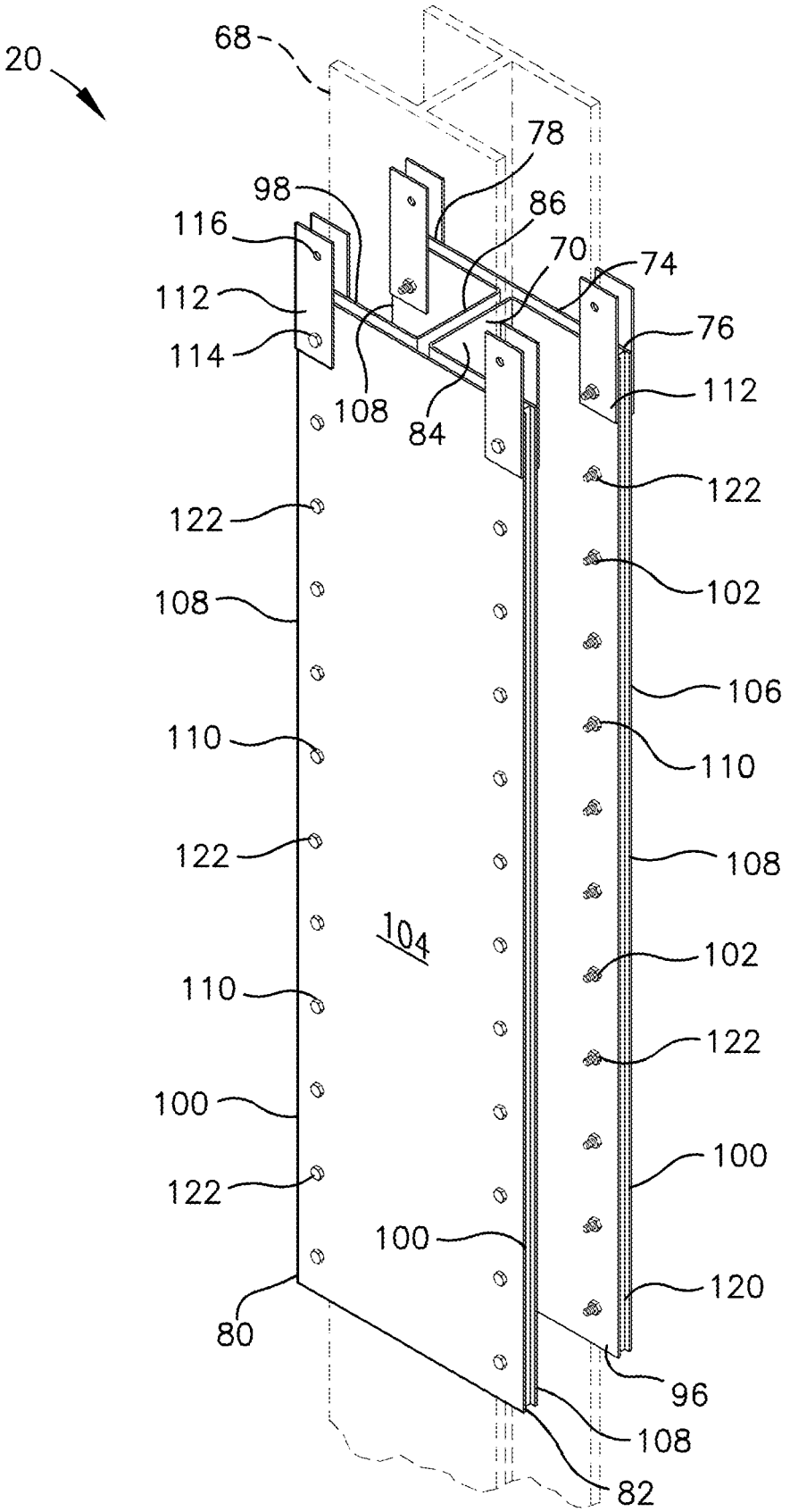
FIG. 6 is an isometric view of the embodiment of FIG. 5 installed on an H-pile.

Still referring to FIG. 2, the interior surface of the cylinder 34 is covered with a high friction mesh 48, preferably expanded metal that is coated with epoxy, polyurethane or the like to prevent the sharp edges of the mesh from cutting through the protective tape wrap 14. The mesh 48 can be secured to the pile before the jacket segment 22 is applied, but, preferably, the mesh 48 is secured to the inner surface 49 of the jacket segment 22, i.e., the arcuate segments 24, 26, 28 because in this case these parts can be joined on dry land, which saves an underwater step. The mesh 48 can be secured to each arcuate section 24, 26, 28 by welding, screws, nuts and bolts, adhesive or any other type of fastener system. A separate section of the mesh 48 is applied to each arcuate segment 24, 26, 28, but the preferred method of securing the mesh 48 to the inner surface 49 of each arcuate section 24, 26, 28 is by the tack welds 55. In any case, the mesh 48 or substitute is firmly in contact with the pile throughout the entire length of the protective jacket 20 and throughout the surface area of the pile to be covered, regardless of the type of cross section of the pile, to prevent the protective jacket 20 from slipping down the pile 6. In any case, the mesh 48 is interposed between the protective jacket 20 and the pile 6 or 68 (FIGS. 5-6). The mesh 48 is preferably coextensive with the pile surface portion to be protected, whether used to protect a cylindrical pile 6 or an H-pile 68 or other shape of pile. In some applications it may be possible to use mesh 48 segments that are smaller than those needed for coextensive contact with the pile 6, 68 or the like.

Figure 3:
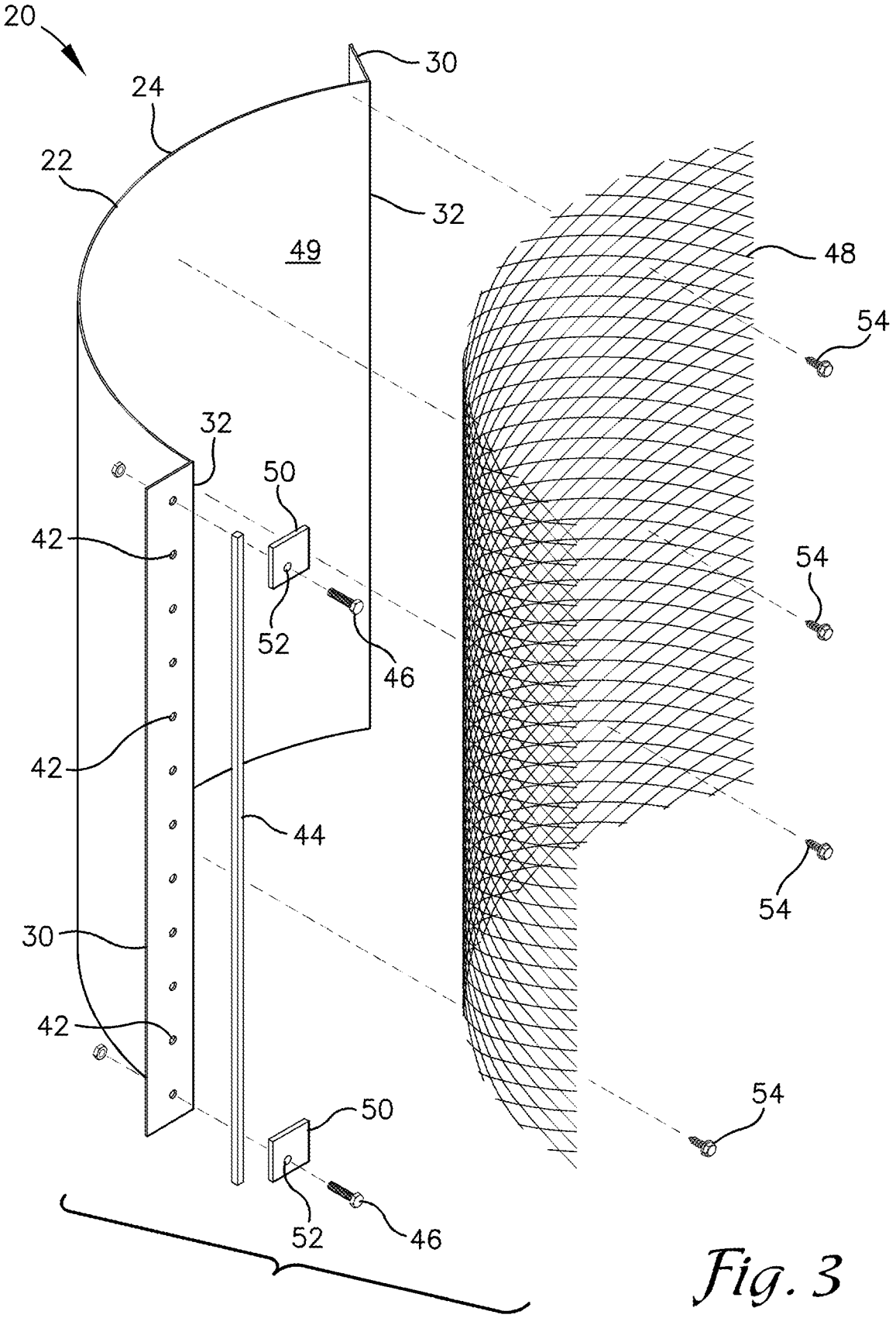
FIG. 3 is an exploded isometric view of a segment of the protective jacket of FIG. 2.

Referring to FIG. 3, a square spacer plate 50 is placed at the between two flanges 30 at the lowest hole 42 and a separate spacer plate 50 is placed between the two flanges 30 at the topmost hole 42. Each square spacer plate 50 has a hole 52 and a bolt and nut 46 are inserted through the holes 52 as well as the lowest and topmost holes 42 in the flanges 30. This assembly is repeated for each of the three arcuate segments 24, 26, 28. The mesh 48 is held in place, as shown, by the machine screws 54, which may have large heads or be used with flat washers or is otherwise fixed to the inner surface 49 of each arcuate segment 24, 26, 28. The mesh 48 may be a different type of material, such as a nylon mesh similar to common scouring pads or any type of mesh that has a large number of stands that project outwardly from the general plane of a mesh web. A mesh is a barrier made of connected strands of metal, fiber, or other flexible materials, which are typically ductile under certain conditions. A mesh is similar to a web or a net in that it has many attached or woven strands. Any type of friction increasing inner surface 49 or material attached to the inner surface 49 of each arcuate segment 24, 6, 28 could be suitable, for example, a scoured inner surface 49, or a machined inner surface 49 that creates apparently random grooves in the inner surface 49 or a rough coating on the inner surface 49, such as a deep textured polyurethane coating. Any such alternative to the expanded metal mesh 48 would need to be long lasting and resistance or is impervious to water degradation and corrosion.

Figure 4:
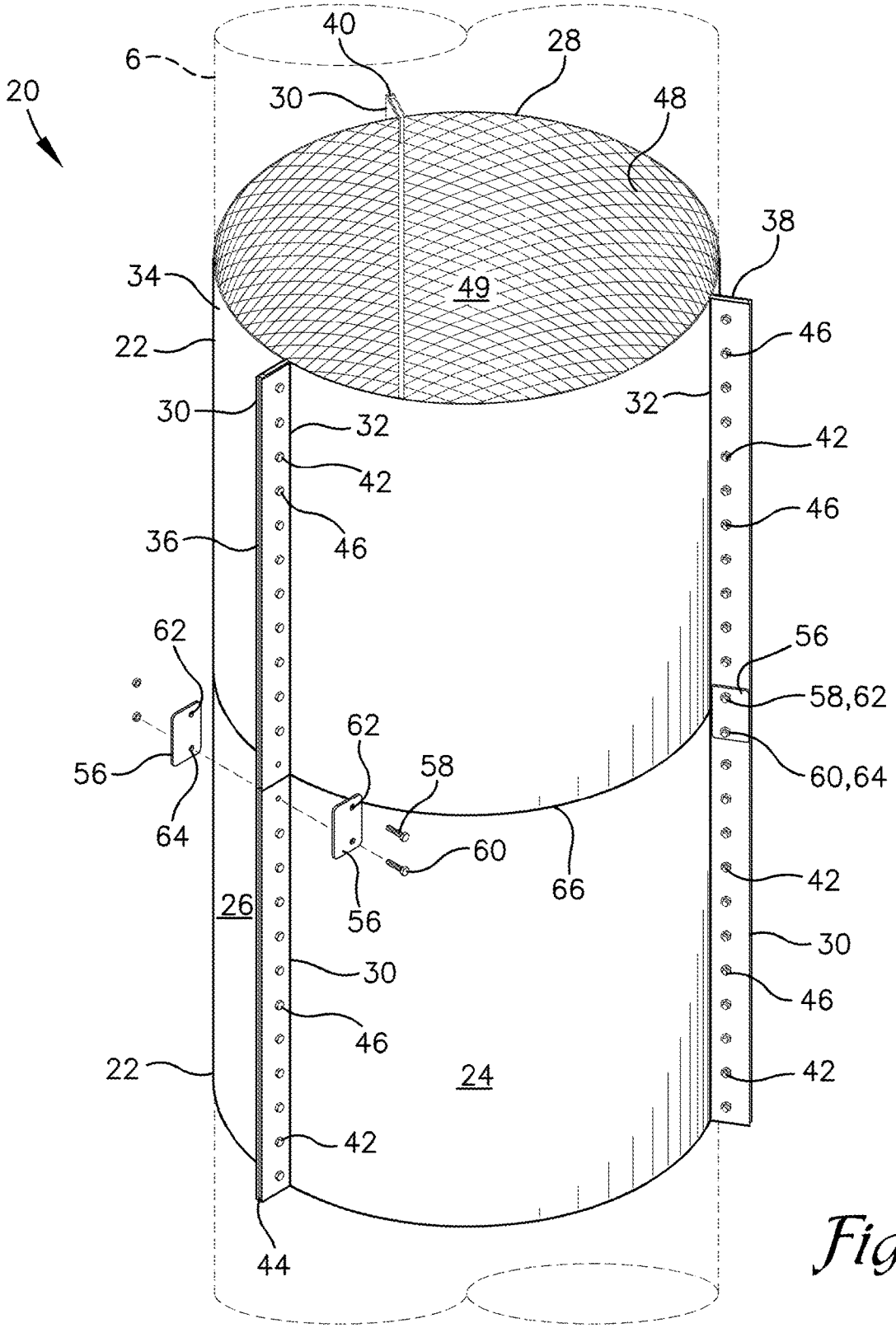
FIG. 4 is an isometric view of an assembled protective jacket of FIG. 2 shown installed on a pile.

Referring to FIG. 4, a number of jacket segments 22 may be stacked on above or below another with a reinforcement plate 56 placed on each side of two mating flanges 30 and secured with an upper nut and bolt 58 and a lower nut and bolt 60 inserted through the corresponding upper hole 62 and lower hole 64 and the corresponding holes 42 in the two mating flanges 30. The middle of each reinforcement plate 56 lies along the horizontal seam 66 between adjacent jacket segments 22, so that the upper hole 62 secures the jacket segment 22 adjacent to a lower jacket segment 22, with the lower hole 64 in the reinforcement plate 56 used to secure the reinforcement plate 56 to the lower jacket segment 22. In this fashion, up to four jacket segments 22 can be stacked one above another and then connected to one another in the present embodiment. Larger reinforcement plates 56 would allow more jacket segments 22 to be stacked.

Referring to FIGS. 5, 6, the H-pile 68 is an I-beam stood on end and driven into the ground. The H-pile 68 includes a flat central beam portion 70, having a first flat side portion 71, which in turn includes a first flange portion 72 and a second flange portion 75, with both flange portions 72, extending the length of the flat central beam element 70 and lying parallel to one another. A second flat side portion 75 of the H-pile 68 has a first flange portion 76 and a second flange portion 78 both extending outwardly from the flat central beam portion 70. The flange portions 72, 75, have vertical edges 80, 81 and the flange portions 76, 78 have vertical edges 82, 83 that extend outwardly of the flat central beam portion 70. The H-pile 68 therefore has a first channel portion 84 and a second channel portion 86. Each flange portion 72, 74, 75, 78 is parallel to every other flange portion 72,74, 75, 78 and perpendicular to the flat central beam portion 70 with the flange portions 72, 74, 75, 78 forming arms, each extending away from the flat central beam portion 70.

A protective wrap 88 is wrapped around the H-pile 68 in the splash zone. The protective wrap 88 may be applied in strips to all flat surfaces of the H-pile 68. Alternatively, the protective wrap 88 may be loosely about the H-pile 68 in a spiral wrap, which is then brought up tightly against the H-pile 68 by the H-pile 68 embodiment of the protective jacket 20. The later method results in a seamless protective wrap 88, making it more effective than applying the protective wrap 88 in strips. The H-pile 68 has a deteriorated portion 90. The splash zone, that is, the area to be treated with the protective wrap 88 is denoted by the upper splash zone line 92 and the lower splash zone line 94.

The H-pile 68 embodiment of the protective jacket 20 includes a number of plates, or jacket members, that fit about the H-Pile 68 and are tightened by bolts or the like. A first U-shaped channel member 96 of the H-pile 68 embodiment of the protective jacket 20 fits into, that is, mates with, the first channel portion 84 of the H-pile 68. A second U-shaped H-pile channel member 98 of the H-pile 68 embodiment of the protective jacket 20 channel member 98 fits into, that is mates with, the second channel portion 86 of the H-pile 68. Each U-shaped channel member 96, 98 has a two outer edges 100 that extend outwardly beyond the outer edges of the channel portions 84, 86 of the H-pile 68, that is, the depth of each U-shaped channel member 96, 98, is greater that the depth of the H-pile channel portions 84, 86. Adjacent to the outer edges of each U-shaped channel members 96, 98 is a vertically oriented plurality of holes 102, which lie outside the outer edges of the channel portions 84, 86 of the H-pile 68.

A first flat plate member 104 is placed against the first flange portion 72 of the H-pile 68 and a matching second flat plate member 106 is adapted to be placed against the second flange portion 74 of the H-pile 68. Both of the flat plate member 104, 106 has two vertical edges 108, each having a row of holes 110 adjacent to the vertical edges 108, which align with the holes 102 of the first and second U-shaped channel members 96, 98. Each of the first U-shaped channel member 96, the second U-shaped channel member 98, the first flat plate member 104 and the second flat plate member 106 is a jacket member.

A connector plate 112 is placed at the upper and lower edges of each corner of the members of the H-pile 68 embodiment of the protective jacket 20, with each connector plate 112 having a first hole 114 that aligns with the hole in a member of the H-pile 68 embodiment of the protective jacket 20 and a second hole 116, which allows multiple segments of the H-pile 68 embodiment of the protective jacket 20 to be connected together to protect a longer section of the H-pile 68.

A mesh panel 118, of the same composition as the mesh 48 (FIGS. 2-4), which is flat, rectangular, is fashioned to the width of the first and second flat side portions 71, 75 the H-pile 68 and the length of the H-pile that is to be protected. These two mesh panels 118 provide sufficient gripping power to hold the H-pile 68 embodiment of the protective jacket 20 in place on the H-pile when the bolts are tightened. If desired, however, mesh panels that fit into the first and second channel portion 84, 86 and may cover only the innermost surface of the first and second channel portions 84, 86 or may be themselves U-shaped and contact all the surfaces of the first and second channel portions 84, 86. Any mesh panel 118 for use with an H-pile can be fastened to the corresponding jacket segments as described above in connection with the protective jacket 20, which is adapted for use with a cylindrical pile 6. The areas of the mesh panels 118 are preferably coextensive with the entire surface of the first flat side portion 71 and the second flat side portion 75 that are to be protected.

A spacer rib 120 is fixed along each vertical edge of the first and second fat panel members 104, 106 on their inner surfaces, that is, the surface that will face the H-pile 68. The spacer ribs 120 lie between the outer vertical edges 108 of the flat panel members 104, 106 and the vertical rows of hole 110, allowing the flat panel members 2104, 106 to bend into tight contact with the H-pile when the fasteners 122 are tightened. A fastener 122 is inserted into each of the aligned holes shown and are tightened to draw the H-pile 68 embodiment of the protective jacket 20 tightly against the H-pile, covering and securing the protective wrap 88 to the H-pile 68 and to protect the protective wrap 88 from water waves.

Every part of the protective jacket 20 is coated with anti-corrosion material, for example, epoxy, plastic, thermal spray compound, galvanized or the like to reduce or prevent corrosion. The protective anti-corrosion coating is applied to each piece and part of the protective jacket 20, whether before, during or after assembling of the jacket segments. The protective jacket 20 can be made of any suitable material, but is preferable made from 10 gauge steel, which is strong enough to be clamped firmly against a pile, but is fairly light weight, weighing approximately 135 kg. (300 lbs.), allowing the protective jacket to be handled and installed more easily that if the protective jacket were heavier. The light weight is possible because the protective jacket is not a structural element since its sole function is to protect a protective tape wrap or protective coating on a pile.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. An apparatus for protecting a substrate on a pile immersed in water comprising:

a. a plurality of jacket members shaped to embrace a pile of a certain cross section;
b. at least one flange member along each of two vertical edges of each said jacket member;
c. a vertically oriented row of holes in each said flange member;
d. fasteners inserted into each said hole of each said flange member tightened to clamp connected jacket members together;
e. a mesh interposed between each said jacket member and said pile;
f. a protective tape wrapped around said pile; and
g. wherein said mesh lies in direct contact with an interior surface of each said jacket member and with said protective tape.

2. An apparatus in accordance with claim 1 wherein said mesh is an expanded metal mesh.

3. An apparatus in accordance with claim 1 wherein said mesh is fastened to an inner surface of each said jacket member.

4. An apparatus in accordance with claim 1 wherein said mesh is coextensive with the pile surface portion to be protected.

5. An apparatus in accordance with claim 1 further wherein said mesh is coated with a corrosion-proof coating.

6. An apparatus for protecting a substrate on a pile immersed in water comprising:

a. a jacket segment having a plurality of arcuate segments;
b. a flange projecting outwardly from each long edge of each arcuate segment, with each said flange running the length of each said arcuate segment and a plurality of holes in a row in each said flange arranged so that each said row of holes in one said flange align with said row of holes in any other said flange;
c. a mesh inserted between the pile and said jacket segment;
f. a protective tape wrapped around said pile; and
g. wherein said mesh lies in direct contact with an interior surface of each said jacket member and with said protective tape.

7. An apparatus in accordance with claim 6 wherein said jacket segment further comprises three arcuate segments each comprising an arc of one-third of the circumference of a circle.

8. A apparatus in accordance with claim 7 further comprising three sets of two said flanges adjacent to one another in said jacket segment.

9. An apparatus in accordance with claim 7 further comprising a spacer bar between each set of two said adjacent flanges, with said spacer bar being located adjacent to an outer edge of each set of two said adjacent flanges and outside the rows of said holes and said spacer bar runs the length of said flanges.

10. An apparatus in accordance with claim 9 further comprising fasteners inserted into said holes.

11. An apparatus in accordance with claim 10 further comprising securing each said adjacent jacket segment to an adjacent said jacket segment with a plurality of reinforcement plates secured to said flanges of said jacket segments, thereby covering a portion of said flanges above and below a horizontal seam formed by two vertically stacked said adjacent jacket segments.

12. An apparatus in accordance with claim 7 wherein said mesh is fixed to an inner surface of each said arcuate segment.

13. An apparatus in accordance with claim 7 further comprising a spacer plate inserted between one said flange of pair of adjacent said flange and said spacer bar at a top hole and a spacer plate inserted between one said flange of pair of adjacent said flange and said spacer bar at a bottom hole of two adjacent said flanges.

14. An apparatus in accordance with claim 7 further comprising stacking a plurality of jacket segments one above the other to form a protective jacket.

15. An apparatus in accordance with claim 6 further comprising an anti-corrosion material applied to each part of said protective jacket.

* * * * *